United States Patent [19]

Woodruff et al.

[11] 4,432,102

[45] Feb. 21, 1984

[54] DISPENSING PACKAGE FOR AUTOMATICALLY RELEASING A CONTROLLED AMOUNT OF AN ADDITIVE SOLUTION INTO A WATER TANK AND BOWL

[75] Inventors: Keith Woodruff, Mountainside; Arturo A. Villamarin, Mine Hill, both of N.J.

[73] Assignee: American Cyanamid Co., Stamford, Conn.

[21] Appl. No.: 313,408

[22] Filed: Oct. 21, 1981

[51] Int. Cl.[3] ..... E03D 9/02; E03D 9/01

[52] U.S. Cl. ..... 4/228; 4/227

[58] Field of Search ..... 4/227, 222, 228; 222/190, 189

[56] References Cited

U.S. PATENT DOCUMENTS

| | | | |
|---|---|---|---|
| 3,121,236 | 2/1964 | Yadro et al. | 222/190 X |
| 3,545,014 | 12/1970 | Davis | 4/228 |
| 3,618,143 | 11/1971 | Hill et al. | 4/228 |
| 3,715,765 | 2/1973 | Yadro | 4/DIG. 10 UX |
| 3,837,017 | 9/1974 | McDuffee | 4/DIG. 10 |
| 4,096,593 | 6/1978 | Nahakis | 4/231 |
| 4,186,856 | 2/1980 | Dirsking | 4/228 X |
| 4,208,747 | 6/1980 | Dirsking | 4/228 |
| 4,281,421 | 8/1981 | Nyquist et al. | 4/228 |
| 4,305,162 | 12/1981 | Cornelisse, Jr. | 4/228 |
| 4,307,474 | 12/1981 | Choy | 4/228 |

*Primary Examiner*—Henry K. Artis

*Attorney, Agent, or Firm*—William H. Calnan

[57] ABSTRACT

A device for dispensing additives to the tank and bowl of a flushable toilet. More particularly, the invention relates to such a device having no moving parts, but which nevertheless dispenses a predetermined quantity of additive with each flush.

16 Claims, 11 Drawing Figures

DISPENSING PACKAGE FOR AUTOMATICALLY RELEASING A CONTROLLED AMOUNT OF AN ADDITIVE SOLUTION INTO A WATER TANK AND BOWL

The present invention relates generally to a device for dispensing additives to the tank and bowl of a flushable toilet. More particularly, the invention relates to such a device having no moving parts, but which nevertheless dispenses a predetermined quantity of additive with each flush.

Devices for dispensing additives to a toilet tank are well known.

One form of such a device is disclosed in U.S. Pat. No. 3,837,017. It consists of a container having a number of perforations in the top containing solid calcium hypochlorite. The device rests in the bottom of the tank where water enters the perforations and dissolves calcium hypochlorite which disperses throughout the tank water, which is then passed through the bowl upon flushing. Such devices suffer from the disadvantage that there is no control over the amount of dissolution of the calcium hypochlorite. Moreover, there is a more or less continuous evolution of gases from the reaction of the calcium hypochlorite with the water. The result is that the effectiveness of the device will be greater in the initial stages of use than at a later stage.

Another type of device is disclosed in U.S. Pat. No. 3,618,143. This device contains a large compartment containing the additive and an opening for admitting water, and a second smaller compartment containing an exit for water and dissolved additive, the compartments being joined below the level of both opening and exit, the exit being below the level of the opening. Such a device will dispense a pre-determined amount of liquid with each flush. However, this type of device has a disadvantage in that the solid additive is completely covered by water at all times and thus is in a continuous state of dissolution. This will result in faster use up time.

Still other types of devices are disclosed in U.S. Pat. No. 4,171,546. These devices also comprise a compartment for containing the additive material, an opening for admitting water, and a reservoir for containing a quantity of a solution. However, these devices are complex and all rely on a system of air-locks in order to isolate the additive material and the additive solution from the toilet tank water during quiescent periods.

The complexities and disadvantages of prior art devices may be eliminated by the use of the present invention. This invention comprises a device which is placed in a toilet tank, which device contains a water-soluble tablet of additive material intended to be used to treat the water in the toilet tank and/or bowl. By water-soluble is meant that the material will provide a solution when in contact with water over a period of time. Exemplary additives include disinfectants, deodorizers, cleaners, fragrances, dyes, stain inhibitors and the like, as well as additives which exhibit two or more of these properties.

The device of the instant invention permits a predetermined amount of additive solution to be discharged into the toilet tank and/or bowl from an outlet port of the device during each flush cycle. The tablet is positioned in a cavity within the device such that water has a predetermined amount of contact therewith, it being understood that there must be some contact of the tablet with the water so that additive solution may be formed.

Tablet positioning such that water has only minimum contact with the tablet would, of course, prevent excessive dissolution of the tablet and prolong the life of the additive compound, a desirable situation when the tablet is relatively very water-soluble. However, when the tablet is relatively less water-soluble, it is desirable that the water remain in contact therewith. Generally, the less water-soluble the tablet, the more thereof would be in contact with the water in order to create sufficient additive solution.

A second cavity is also provided in the device, said second cavity communicating with the tablet cavity and holding a solution of the dissolved additive material. Preferably, this second cavity is large in comparison to the predetermined quantity of additive solution which is delivered to the tank and/or bowl with each flush. This is an important, but optional, feature of the device which permits substantial uniformity of additive delivery to the toilet tank and/or bowl during each of numerous, closely-spaced flushes. Depending, inter alia, upon the stability of the tablet and the solution resulting from the contact of water therewith, the size of the second cavity may be adjusted accordingly.

In operation, as the toilet is being flushed, a predetermined amount of water flows into the solution cavity and this predetermined amount of water causes a corresponding amount of additive solution to be discharged from the cavity and substantially into the tank. By appropriately positioning the device in the tank, the optimum amount of the additive solution may be transferred into the tank and/or bowl during the flush, and remain therein during the quiescent period before the next flush. Other variables such as, for example, the size of the predetermined amount of additive solution to be delivered to the tank and/or bowl, may also be adjusted to provide optimum functioning of the device as desired.

The invention may be better understood by reference to various embodiments illustrated in the accompanying drawings, in which.

Figure 3:
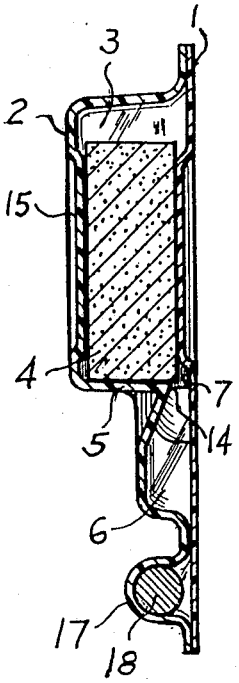
FIG. 3 is a side cross-sectional view in elevation taken along the lines 3—3 of FIG. 1.

Referring to the drawings, the dispensing device of the application may be made of a plastic or other suitable material which is inert to the additive material. As shown, rear panel 1 and front panel 2 are secured together at contacting points and this may be done in any suitable manner depending on the materials of construction, for example, by adhesive bonding, or thermal bonding of plastic materials. Specifically referring to FIGS. 1 through 6, the device basically comprises a flat rear panel 1 and a shaped front panel 2. Front panel 2 has a first cavity 3 for containing an additive tablet 4 which rests on a shelf 5 formed at the base of cavity 3. A second cavity 6 is formed in front panel 2 and positioned below cavity 3. Cavities 3 and 6 are in communication with each other at opening 7 along the edge of shelf 5. An inlet port 8 is provided into an inlet standpipe cavity 9 and an outlet port 10 is provided from an outlet standpipe cavity 11. Port 10 will preferably be above the level of shelf 5, so that delivery of additive solution to the toilet tank during quiescent periods is substantially prohibited, and port 8 will be above the level of port 10. Both standpipe cavities 9 and 11 communicate with cavity 6 at openings 12 and 13 respectively. The upper surface 14 of opening 12, in FIG. 3, is positioned slightly below the lower surface of shelf 5, as is the corresponding upper surface of opening 13. In such a construction, the water will be relatively minimally in contact with the tablet 4. During quiescent periods, a convex meniscus of water is created by capillary forces and a portion of the lower surface of tablet 4 is contacted thereby. When the toilet is being flushed, however, this contact is broken. It is understood that the relative positioning of tablet 4, and the upper surface of either opening 12 or 13 will control the amount of contact between the water and tablet 4.

The tablet 4 is contained in cavity 3 in such a manner that is has minimum contact with the inner walls thereof by means of indented ribs 15 provided on the front, rear and side walls of the cavity, as formed by rear panel 1 and front panel 2. The lower ends of ribs 15 are above the top surface of shelf 5 (See FIG. 3).

The dispensing device may be positioned in the toilet tank by suspending it with a rod, wire, chain or the like at perforation 16. If necessary, ballast weight may be provided in a ballast cavity 17 such as by a metal bar 18 or the like. Alternatively, the dispensing device could be clamped to a standpipe in the toilet tank by any suitable clamp means attached to the device, not shown. It is to be understood, however, that the particular means used to suspend the device in the toilet tank do not constitute a feature of the invention.

Figure 5:
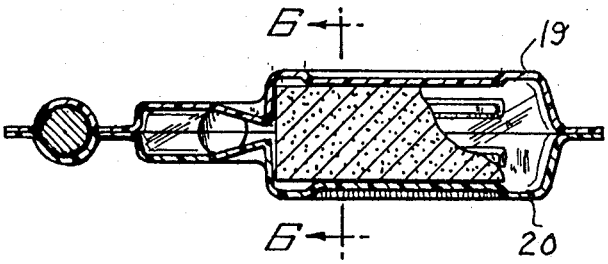
FIG. 5 is a cross-sectional view in elevation of a modified construction of the device taken along the lines 5—5 of FIG. 1.
Figure 6:
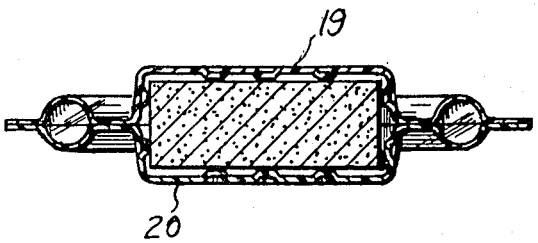
FIG. 6 is a cross-sectional plan view of the modification of FIG. 5, taken along the lines 6—6 of FIG. 5.

A modification of the device is shown in FIGS. 5 and 6. In this modification, both panels 19 and 20 are shaped to form the cavities as described above, the construction and operation of the device being otherwise essentially similar to that of FIG. 1.

In operation, the dispensing device having, for example, a tablet of a material which upon dissolution produces hypohalite ion, is placed in the toilet tank such that the level of water in the tank will be above inlet port 8 at the highest water level during quiescent periods, and below outlet port 10 at the lowest water level during a flush cycle. When the device is initially placed in the tank, water enters through ports 8 and 10 and fills cavity 6, coming in contact with the exposed lower surface of additive tablet 4 which begins to dissolve and form additive solution in cavity 6. As shown, the exposed lower surface of tablet 4 may also be limited to a desired degree by an adjustment in the area of shelf 5. During a flush cycle, as the water level lowers, it will reach the level of port 8, and pass below port 8. As the level goes below port 8, additive solution begins to discharge from cavity 6 and exit the device through outlet port 10, until the tank water level passes below the level of port 10. The amount of discharge from the dispenser, i.e., the predetermined amount, will be equal to the volume of standpipe 9, between the levels of ports 8 and 10. This, of course, may be determined by the difference in height between ports 8 and 10 and the cross sectional area of the standpipe 9, all of which may be adjusted according to the additive compound being used and the amount of solution desired to be discharged during each flush cycle. After the water level reaches its lowest point, and begins to rise, water will enter port 10 and continue to fill the device until the water level rises above port 8.

After completion of the flush cycle and during the quiescent period, water will be in contact with the lower surface of tablet 4. However, when the additive material is such that contact of the water therewith causes evolution of gases, such as, for example, sodium dibromoisocyanurate wherein the gas evolved is primarily oxygen with traces of bromine, said gas will fill cavity 3 and eventually force the level of the water down so that it no longer is in contact with tablet 4, and there is no further dissolution of the tablet during the quiescent period. In addition, ribs 15, being above the level of shelf 5, prevent water from rising in the tablet cavity 3 by capillary action since the tablet is not in contact with the inner walls of the tablet cavity 3.

Thus, by means of the relative positioning of tablet 4 and the upper surfaces of openings 12 and/or 13, and/or adjustment in the area of shelf 5, and the use of a gas back pressure when the additive material is such that gas is evolved when water is in contact therewith, the exposure of the tablet to water may be controlled as desired. The errosion of the tablet may be regulated, and the life of the system adjusted.

Figure 4:
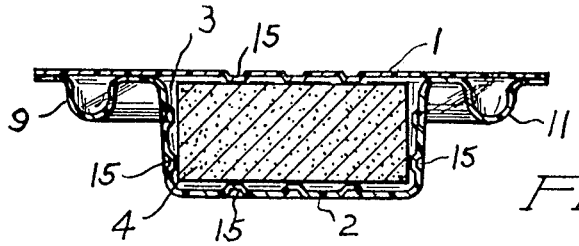
FIG. 4 is a cross-sectional plan view taken along the lines 4—4 of FIG. 1.
Figure 2:
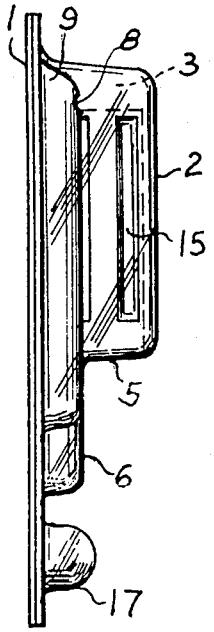
FIG. 2 is a side view in elevation of the device of FIG. 1.
Figure 1:
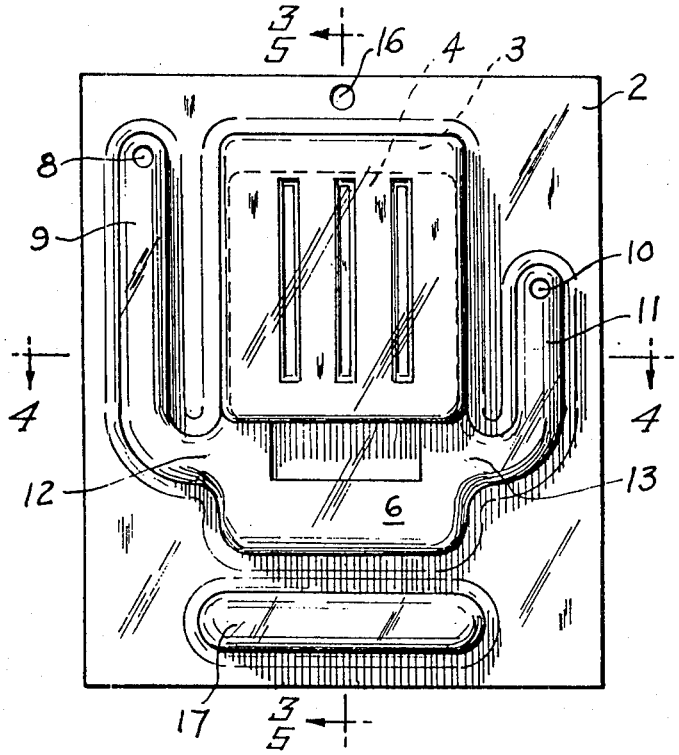
FIG. 1 is a front view in elevation of one embodiment of the dispensing device of the invention.
Figure 9:
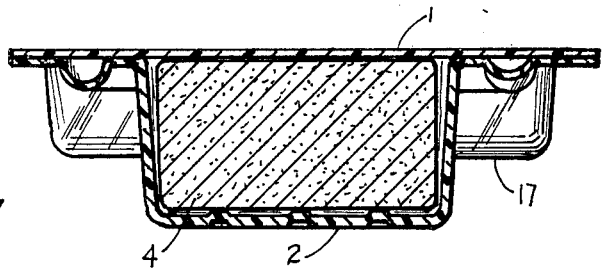
FIG. 9 is a cross-sectional plan view taken along the lines 9—9 of FIG. 7.
Figure 8:
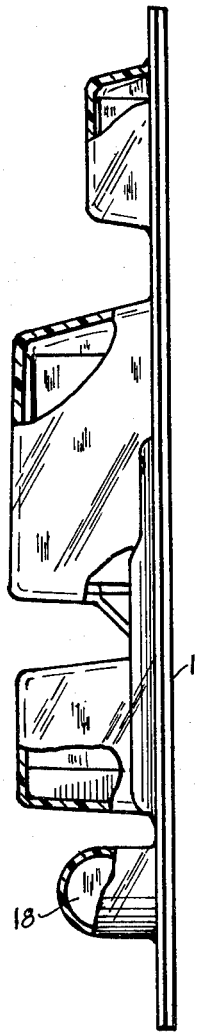
FIG. 8 is the right side view in elevation, with parts broken away to show compartment interiors, taken along the lines 8—8 of FIG. 7.
Figure 7:
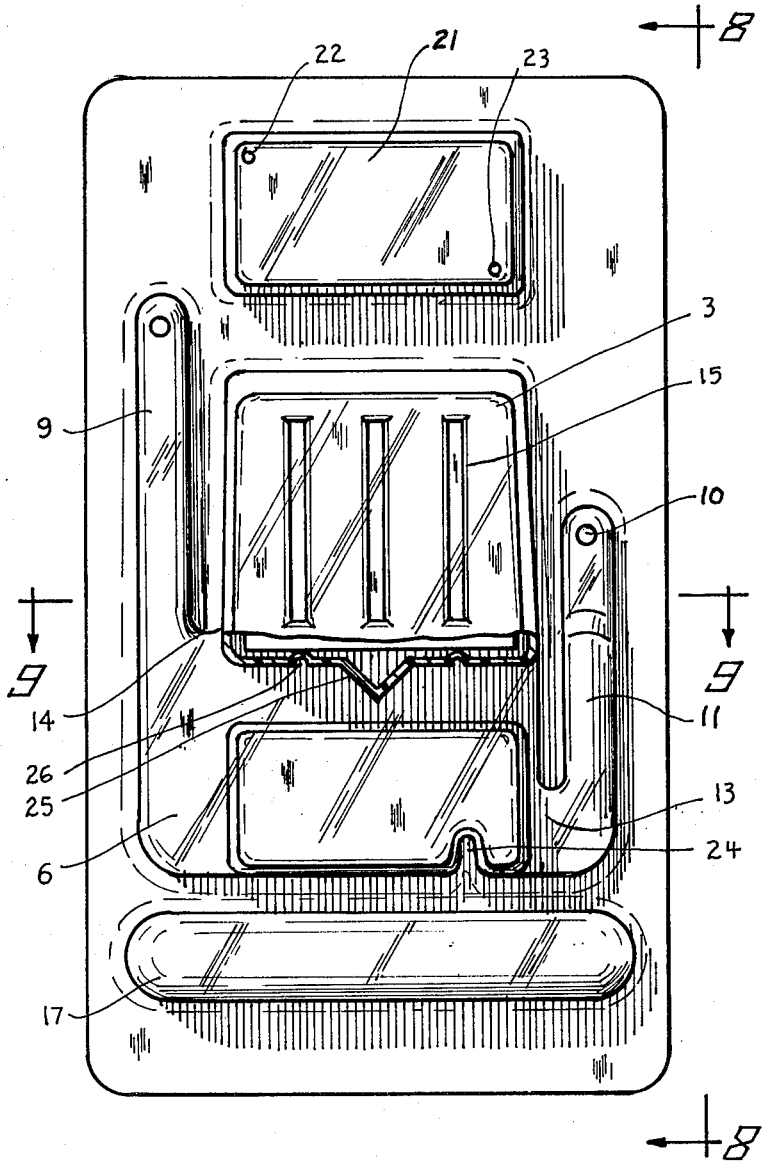
FIG. 7 is a front elevational view of another embodiment of the dispensing device of the instant invention.

Referring now to FIGS. 7–9, an alternative embodiment of the device of the present invention is shown wherein several optional features are exemplified, the construction and operation of the device being otherwise essentially similar to that of FIG. 1.

In FIG. 7, an optional separate chamber 21, located above exit port 10, is incorporated into the device. As illustrated, this chamber 21 is constructed so as to cause a second additive material, in cake form, placed therein to be delivered into the toilet tank continuously and into the bowl during every flush. Such a chamber might be used, for example, when one desires to add an additive material which is incompatible with that contained in tablet 4 to the toilet tank and/or bowl. In a preferred embodiment of the invention, tablet 4 comprises a disinfecting material, and the additive cake material placed in chamber 21 is a dye and/or fragrance which functions as a use-up signal for the tablet 4 and/or to mask unpleasant odors. It is to be understood that the particular construction of optional chamber 21 is not critical, it being important only that there be means to admit water thereto and to allow discharge of additive solution therefrom, as represented by ports 22 and 23 in FIG. 7. Obviously, it would also be possible to simply use two (or more) of the present invention's devices in order to add incompatible additives to the toilet tank and/or bowl. The positioning of the devices would, of course, determine how the additive solutions were delivered relative to one another.

FIG. 7 shows another optional modification of the device of the present invention—cavity 3 is tapered from the bottom toward the top thereof. It has been found that certain compositions of tablet 4 swell as they become wetted by the water. When this occurs, the tablet 4 may wedge itself between the ribs 15 and as the lower portion of the tablet 4 erodes, the tablet 4 will not drop down in the cavity to contact the water and create additive solution in cavity 6. By tapering the cavity 3, the tablet 4 will be forced down as it swells, thereby maintaining itself in contact with the water, as above described. Obviously, the degree of tapering will depend, inter alia, upon the shape of the tablet 4 and its composition characteristics.

Still another feature of the device shown in FIG. 7 is the raising of the upper surface 14 of opening 12 in relation to shelf 5 on which tablet 4 rests. It is seen, as discussed above, that the adjustment of the height of said upper surface 14 (and/or the corresponding upper surface of opening 13, not shown) in relation to the lower surface of tablet 4 will permit more or less of the tablet to be exposed to the water, as desired.

A further optional feature of the device illustrated in FIG. 7 is the inclusion, in cavity 6, of a means whereby any water-insoluble material, which may be generated by or otherwise result from the erosion of tablet 4, or which is present in the water supply and enters the device of the present invention, and settles to the bottom of cavity 6, is prevented or inhibited from building up in opening 13, outlet standpipe 11, and/or outlet port 10, and possibly clogging the device, thereby rendering it partially or totally ineffective. In FIG. 7, such means is shown as a dam 24 which is formed in the floor of cavity 6. Said dam 24 preferably extends substantially the entire depth of cavity 6 as shown in FIG. 8. The height of said dam may be varied depending, inter alia, upon the anticipated quantity of insoluble material to be held in solution cavity 6 thereby.

Further with respect to the water-insoluble materials, FIG. 7 shows yet another feature which might be incorporated into the device of the present invention, namely a funnel-like trough 25 located in shelf 5, whereby water-insoluble material in cavity 3 may be more easily passed into cavity 6. As the water washes across shelf 5, the insoluble material will be washed into said trough 25 and down into cavity 6. Obviously, a plurality of such troughs may be employed. Indeed, in one embodiment of the device of the invention, shelf 5 actually comprises the upper edges of adjoining troughs (not shown). When a plurality of troughs are employed, dam 24 is preferably placed such that substantially all water-insoluble material passing into cavity 6 would remain on the side of dam 24 opposite opening 13. Alternatively, shelf 5 may be positioned above the base of cavity 3 and comprise a screen or screen-like in its entirety. Yet another alternative is to have cavities 3 and 6 be, in essence, one cavity with shelf 5 being a screen or screen-like member supporting the tablet thereon.

A still further optional feature of the device of the present invention which is illustrated in FIG. 7 is the incorporation of a plurality of ribs 26 on the upper surface of Shelf 5. These ribs 26 serve both to allow water to pass under the bottom surface of tablet 4, thereby permitting more uniform erosion of the tablet, and also to permit easier removal of water-insoluble material from shelf 5. Obviously, instead of these ribs, other means such as a plurality of bumps might be used to keep the tablet 4 from resting flat on shelf 5. It is also seen that when shelf 5 is as discussed in the preceding paragraph, these ribs may not be necessary.

As is seen in FIG. 7, solution cavity 6 may be enlarged, for example, by squaring off the bottom edge thereof. Obviously, too, the cavity may simply be extended outward from the rear panel 1, as shown, or a combination of these may be used.

Also shown in FIG. 7 is the optional lowering of opening 13 relative to cavity 6. By means thereof, additive solution from the lower portion of cavity 6 is discharged into the tank through standpipe 11 and outlet port 10. Inasmuch as the most saturated portion of additive solution (excluding that small portion which is at the contact point with the tablet) would be at the bottom of cavity 6, such a positioning of opening 13 will permit optimum usage of additive solution with each flush. In addition, such a positioning of opening 13 causes water entering the device through outlet port 10 and discharge standpipe 11 during refilling to be advantageously mixed with the additive solution remaining in cavity 6.

Still a further optional feature of the device of the instant invention is shown in FIGS. 7 and 8. It is preferred that the volume ratio of the solution cavity 6 to that of discharge standpipe 11 be large so that water entering exit port 10 upon refilling of the tank will be substantially completely passed into cavity 6 to form additive solution and the predetermined amount discharged during a flush cycle will be substantially all relatively saturated additive solution, it being understood that some volumetric portion of outlet standpipe 11 may at certain times contain only water or be a very dilute solution of the additive compound. Obviously, there are practical limitations on this ratio, but, for example, by decreasing the volume of outlet standpipe 11, as by reducing its cross-sectional area, the foregoing objectives are substantially met. An advantage is also seen, for a given predetermined discharge amount, in lengthening inlet standpipe 9 and reducing its cross-sectional area, said advantage being that the device is thereby rendered less susceptible to variation in the pre-determined discharge amount due to possible non-vertical alignment of the device in the toilet tank.

Figure 11:
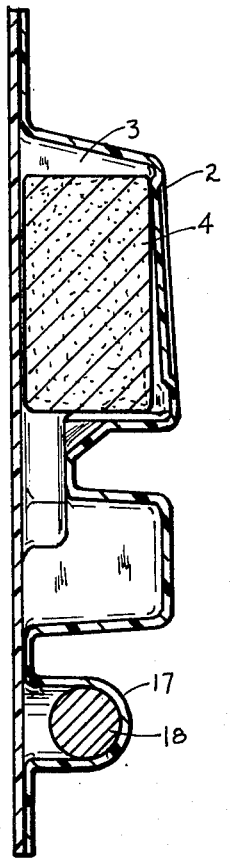
Figure 10:
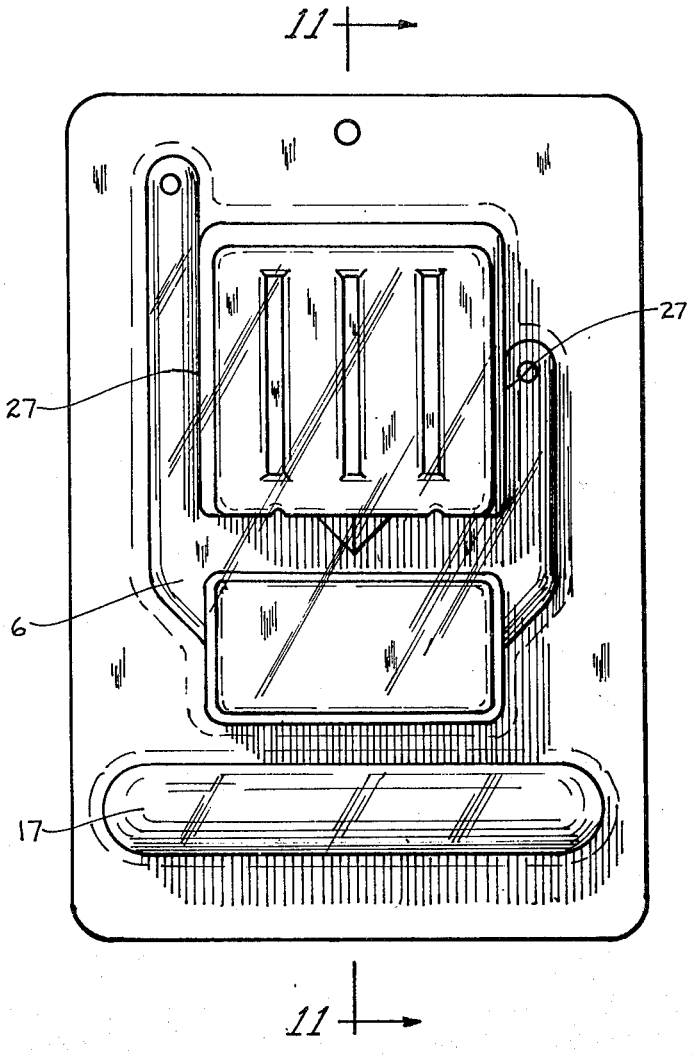
FIG. 10 is a front elevational view of yet another embodiment of the dispensing device of the present invention; and, FIG. 11 is a side cross-sectional view in elevation taken along the lines 11—11 of FIG. 10.

Referring now to FIGS. 10 and 11, a still further embodiment of the present invention's device is shown. When the composition of tablet 4 is such as sodium dibromoisocyanurate, so that the reaction of water therewith evolves gas bubbles, it is preferred that the spaces 27 separating the cavity 3 from the inlet and outlet standpipes, 9 and 11, respectively, be sufficiently narrow, most preferably paper-thin, so that any gas bubbles generated will be more quickly passed into one of said standpipes and out of inlet port 8 or exit port 10. In this manner, gas bubbles may be substantially eliminated as a variable impacting upon the functioning of the device.

EXAMPLE 1

In a particular example, an additive is used in a device of the present invention comprising a mixture of 94 to 98% sodium dibromoisocyanurate 1 to 3% sodium chloride, and 1 to 3% sodium sulfate compressed into a 40 gram tablet. The shelf is designed to expose 10% of the base area of the tablet. The ports 8 and 10 are positioned in such a manner that the device discharges 1.3 cubic centimeters of solution during the flush cycle. This provides an average concentration of hypobromite solution in the solution cavity having a volume of 7.3 cubic centimeters of 10,000 ppm, and, after flushing, about 2 ppm remains in the toilet bowl. In such operation the effective tablet life is approximately two months. By spacing the height of the ports closer together, all other variables being the same, a discharge of 0.4 cubic centimeters may be obtained to provide 1 ppm of hypobromite solution in the toilet bowl after flushing.

The following additional Examples of Tablet formulations may be used in the dispensing device.

EXAMPLE II

| | % by Weight | Amount per 40 gm Tablet |
|---|---|---|
| Dibromodimethyl hydantoin | 96.36% | 38.5 gm |
| $CaSO_4$ | 1.00 | 0.4 |
| Aluminum monostearate | 1.00 | 0.4 |
| Sodium hexametaphosphate | 1.64 | 0.7 |
| | 100.00% | 40.0 |

The mixture of compounds is pressed into a rectangular tablet weighing 40 grams and used in the dispensing device of the invention.

EXAMPLE III

| | % by Weight | Amount per 40 gm Tablet |
|---|---|---|
| Sodium dibromoisocyanurate | 97.9% | 39.16 gm |
| Magnesium stearate | 0.1 | 0.04 |
| Sodium Tripolyphosphate | 2.0 | 0.80 |
| | 100.0% | 40.00 gm |

The listed mixture is pressed into a rectangular tablet as in Example II, and used in the inventive dispensing device.

It is also seen that the tablet may be such that two or more separate additives may be incorporated thereinto, such as, for example, a dye and a disinfectant; or, two or more separate tablets, each containing one or more additives, may be made and stood side by side on shelf 5 of the device, the characteristics of each tablet being such that the rate of erosion will be equal and the tablets will exhaust substantially simultaneously. Obviously, the compositions of the separate tablets are desirably compatible in the sense that the additive materials sought to be discharged in the toilet tank and bowl therefrom will be at least substantially impervious to attack by one another. A still further option is to have one tablet which will provide the principal desired activity, i.e., disinfecting, deodorizing or the like, and a second, thinner tablet placed on top thereof in cavity 3, such as a dye, so that when the principal tablet is exhausted, the second, thinner tablet will begin to produce solution in cavity 6 and such solution will be delivered into the toilet bowl, signaling to the customer that the device is no longer providing the principal desired activity. Of course, variations and extensions of the foregoing may also be used.

While particular embodiments of the present invention have been illustrated and described, it will be obvious to those skilled in the art that various changes and modifications can be made without departing from the spirit and scope of the invention and it is intended to cover, in the appended claims, all such modifications as are within the scope of the invention.

What is claimed:

1. A dispensing device for a flushable toilet tank comprising means to contain a compressed tablet of a solid additive, means to contain an aqueous solution of said solid additive, said aqueous solution containing means being positioned below said tablet containing means with an opening communicating between said additive tablet containing means and said solution containing means, means to admit water into said device, means to pass a predetermined quantity of said aqueous solution out of said device during a flush cycle, and means to control contact between said tablet and said aqueous solution to obtain a desired concentration of said aqueous solution; said water admitting means and said means to pass a predetermined quantity of said aqueous solution out of said device being in liquid contact with the water in the toilet tank during quiescent periods.

2. The dispensing device of claim 1 wherein said additive is a disinfectant, a deodorant, a dye, a fragrance, a stain inhibitor, a cleaner or a compatible mixture of two or more thereof.

3. The dispensing device of claim 1 comprising means to restrict the area of said tablet in contact with said aqueous solution.

4. The dispensing device of claim 1 comprisng a means to permit substantially uniform erosion of said tablet.

5. The dispensing device of claim 1 wherein said means to pass a predetermined quantity of said aqueous solution out of said device comprises a pair of ports, one port being located higher vertically than the other port, both of said ports being located above said solution containing means.

6. The dispensing device of claim 1 wherein the means to contain said tablet also has means to permit only minimum contact of said tablet with said tablet containing means.

7. The dispensing device of claim 1 further comprising a separate means to contain a compressed tablet of a second solid additive, means to pass water into said separate means, and means to pass a aqueous solution of said second solid additive out of said separate means.

8. The dispensing device of claim 1 wherein the means to contain said tablet comprises a chamber having walls at least one of which slopes inwardly from bottom to top.

9. The dispensing device of claim 1 wherein the means to contain said solution of said additive contains a means therein whereby water-insoluble material is held in said aqueous solution containing means.

10. The dispensing device of claim 1 wherein the means to contain said tablet comprises a shaped chamber having a supporting means for maintaining said tablet in said chamber, said supporting means having conducting means for conducting solids in solution or suspension into said solution containing means.

11. The dispensing device of claim 10 wherein said supporting means comprises a shelf comprising at least one trough as conducting means.

12. The dispensing device of claim 1 wherein the means to contain said tablet comprises a shaped chamber having a supporting means for maintaining the tablet in said chamber, said supporting means allowing substantially uniform contact of the bottom of said tablet with water.

13. The dispensing device of claim 12 wherein said supporting means comprises a shelf having a plurality of raised elements, or a screen.

14. The dispensing device of claim 1 wherein said means to contain said aqueous solution of said additive is of sufficient capacity to contain a plurality of said predetermined quantities.

15. The dispensing device of claim 1 wherein a pair of standpipes are connected to said solution containing means, each standpipe having a port located therein, the port of one standpipe being higher than the solution containing means and the port of the other standpipe, at least the other standpipe being connected to said solution containing means substantially at the base thereof.

16. A dispensing device for a flushable toilet tank comprising a first cavity adapted to contain a tablet of a solid, water-soluble additive, a second cavity adapted to contain an aqueous solution of said additive and positioned below said first cavity, an opening communicating between said first and second cavities, a pair of standpipes each being positioned separately adjacent to said cavities, and having a port in the upper portion thereof opening to said tank, the bottom of each standpipe being in communication with the second cavity and the port of one standpipe being positioned above the second cavity and the other port such that a predetermined quantity of said aqueous solution is passed out of said second cavity into said tank during a flush cycle, said standpipes being connected to the second cavity in such a manner that contact between said tablet and said aqueous solution is controlled to obtain a desired concentration of said aqueous solution.

* * * * *